US009583072B2

(12) United States Patent
Zhu

(10) Patent No.: US 9,583,072 B2
(45) Date of Patent: Feb. 28, 2017

(54) SPATIAL DITHERING FOR A DISPLAY PANEL

(71) Applicant: ATI Technologies ULC, Markham (CA)

(72) Inventor: Minghua Zhu, Markham (CA)

(73) Assignee: ATI Technologies ULC, Markham, Ontario (CA)

( * ) Notice: Subject to any disclaimer, the term of this patent is extended or adjusted under 35 U.S.C. 154(b) by 296 days.

(21) Appl. No.: 14/225,513

(22) Filed: Mar. 26, 2014

(65) Prior Publication Data

US 2015/0279319 A1 Oct. 1, 2015

(51) Int. Cl.
*G09G 5/02* (2006.01)

(52) U.S. Cl.
CPC ..... *G09G 5/026* (2013.01); *G09G 5/02* (2013.01); *G09G 2320/0242* (2013.01); *G09G 2320/0276* (2013.01); *G09G 2320/0666* (2013.01); *G09G 2340/0428* (2013.01); *G09G 2340/06* (2013.01)

(58) Field of Classification Search
None
See application file for complete search history.

(56) References Cited

U.S. PATENT DOCUMENTS

2004/0243383 A1* 12/2004 Garino ..... G06F 17/5022 703/23
2005/0021579 A1* 1/2005 Bae ..... G09G 3/2055 708/300
2005/0289485 A1* 12/2005 Willis ..... G01R 31/318364 716/104
2007/0024636 A1* 2/2007 Lo ..... G09G 3/2048 345/596
2011/0320046 A1* 12/2011 Drouin ..... G02B 26/105 700/280
2014/0356844 A1* 12/2014 Bharadwaj ..... G06F 17/241 434/362
2015/0336676 A1* 11/2015 McCann ..... B64D 15/00 701/3

* cited by examiner

*Primary Examiner* — Yingchun He
(74) *Attorney, Agent, or Firm* — Volpe and Koenig, P.C.

(57) ABSTRACT

A method, a device, and a non-transitory computer readable medium for performing dithering on an L bit long input data are presented. An M bit long random data is generated, wherein M is a number of least significant bits of the input data. An M bit long frame counter value is added to the random data. The input data is rounded up to L-M most significant bits when the M least significant bits of the input data is greater than the sum of the frame counter value and the random data. The input data is truncated to the L-M most significant bits when the M least significant bits of the input data is less than or equal to the sum of the frame counter value and the random data.

17 Claims, 5 Drawing Sheets

300
Start
302
Receive L bit long input data
304
Generate M bit long random data
306
Add M bit random data and M frame counter bits
308
Is the M least significant bits of the input data > sum?
No
314
Truncate input data to L-M most significant bits
Yes
310
Round up input data to L-M most significant bits
312
End

500

SPATIAL DITHERING FOR A DISPLAY PANEL

TECHNICAL FIELD

The disclosed embodiments are generally directed to dithering, and in particular, to spatial dithering for a display panel.

BACKGROUND

To display a high color depth image on a low color depth panel (for example, on a panel that is capable of displaying only six bit color), dithering may be used to improve the displayed color quality without visible artifacts. The goal of dithering is to display an average color value for each pixel position. There are two categories of dithering methods, spatial dithering and temporal dithering.

In spatial dithering, an intermediate color of a pixel is achieved with an average color of several adjacent pixels in each area. For example, if the image data is eight bits per color and the panel can display only six bits per color, then the two least significant bits of each color component are dropped.

One implementation of spatial dithering, called random spatial dithering, compares the value of the two dropped bits with two bits of random data. If the dropped two bit value is larger than the random data, then the eight bit input data is rounded up to the most significant six bits. Otherwise, the eight bit input data is truncated to the most significant six bits. By comparing the dropped bits to the random data, the output six bit data can randomly be one of two adjacent integer values. The larger the dropped bits value is, the higher the probability that the output data has a larger integer value.

With random spatial dithering, the random number is added to lower data bits of each pixel and the average color value can be detected by a viewer over a small area with multiple pixels. To avoid visible color patches created when using a fixed random pattern for each frame, the random data pattern is changed from frame to frame. But changing the data pattern may introduce flickering due to a pseudo-random data pattern being applied to each pixel position over time. The flickering may be reduced, but not eliminated, with a horizontal high pass filter on the random noise data.

Table 1 shows an example of different average output values between 61 and 62, with four adjacent pixels and a dithering output of six bits per color. With a six bit output value, fractional values (as shown in the middle column of Table 1) cannot be accurately represented. Within a block of four adjacent pixels, the average value of the pixels within the block can produce the desired equivalent eight bit value. Because the viewer cannot readily perceive individual pixels, the difference between the individual pixels in a given block provides the desired visual effect.

TABLE 1

| Four adjacent pixels with six bit data | Average of four adjacent pixels | Equivalent eight bit value |
|---|---|---|
| 61 61<br>61 61 | 61 | 244 |
| 61 61<br>61 62 | 61.25 | 245 |
| 62 61<br>61 62 | 61.50 | 246 |
| 62 61<br>62 62 | 61.75 | 247 |

Temporal dithering is performed on a single pixel across a sequence of frames, and uses a predefined round-up/truncate pattern to output low color depth data. An intermediate color value is achieved by changing the output data between two adjacent integer values with a certain pattern in consecutive frames. The round-up/truncate pattern is determined by the value of the dropped bits, the horizontal and vertical locations of the pixel on the screen, and the display frame number.

With temporal dithering, the lower data bits of each pixel are added to a certain noise data pattern depending on the x, y coordinates on the screen. The noise data pattern is repeated every N frames. Within each group of N frames, the noise data covers all values between 0 and N−1 on each pixel position with different sequences. The intermediate average color on each pixel can be detected by the viewer over multiple frames.

For example, if the image data has eight bits per color and the panel can display only six bits per color, the two least significant bits of each color component are dropped. Table 2 shows an example of a six bit dithering output in four consecutive frames for different eight bit data input values. The average output color value is achieved by changing the six bit dithering output values between 61 and 62 in a certain pattern based on the value of the dropped bits.

TABLE 2

| Input 8 bit data | Dropped bits value | Frame 1 output data | Frame 2 output data | Frame 3 output data | Frame 4 output data | Average output value | Equivalent to 8 bit |
|---|---|---|---|---|---|---|---|
| 244 | 0 | 61 | 61 | 61 | 61 | 61 | 244 |
| 245 | 1 | 61 | 62 | 61 | 61 | 61.25 | 245 |
| 256 | 2 | 61 | 62 | 61 | 62 | 61.50 | 246 |
| 247 | 3 | 61 | 62 | 62 | 62 | 61.75 | 247 |

Depending on the temporal dithering pattern used and the display panel's dot inverse pattern, there may be visible color strip artifacts. It is difficult to find a perfect temporal dithering data pattern to be used with all existing and new display panels, due to differences in individual panels' dot inverse pattern.

SUMMARY OF EMBODIMENTS

Some embodiments provide a method for performing dithering on an L bit long input data. An M bit long random data is generated, wherein M is a number of least significant bits of the input data. An M bit long frame counter value is added to the random data. The input data is rounded up to L-M most significant bits when the M least significant bits of the input data is greater than the sum of the frame counter value and the random data. The input data is truncated to the L-M most significant bits when the M least significant bits of the input data is less than or equal to the sum of the frame counter value and the random data.

Some embodiments provide a non-transitory computer-readable storage medium storing a set of instructions for execution by a general purpose computer to perform dithering on an L bit long input data. The set of instructions include a generating code segment, an adding code segment, a rounding code segment, and a truncating code segment. The generating code segment generates an M bit long random data, wherein M is a number of least significant bits of the input data. The adding code segment adds an M bit long frame counter value to the random data. The rounding code segment rounds up the input data to L-M most significant bits when the M least significant bits of the input data is greater than the sum of the frame counter value and the random data. The truncating code segment truncates the input data to the L-M most significant bits when the M least significant bits of the input data is less than or equal to the sum of the frame counter value and the random data.

Some embodiments provide a device configured to perform dithering on an L bit long input data. The device includes a random number generator, a frame counter, a first adder, a comparator, a second adder, and a multiplexer. The random number generator is configured to generate an M bit long random data, wherein M is a number of least significant bits of the input data. The frame counter is configured to generate an M bit long frame counter value. The first adder is configured to add the random data and the frame counter value to produce a sum. The comparator is configured to compare M least significant bits of the input data and the sum to produce a comparison signal. The second adder is configured to increment L-M most significant bits of the input data by one. The multiplexer is configured to receive the L-M most significant bits of the input data, the incremented L-M most significant bits of the input data, and the comparison signal, and produce an output based on the comparison signal. The output is the incremented L-M most significant bits of the input data when the M least significant bits of the input data is greater than the sum of the frame counter value and the random data or the L-M most significant bits of the input data when the M least significant bits of the input data is less than or equal to the sum of the frame counter value and the random data.

BRIEF DESCRIPTION OF THE DRAWINGS

A more detailed understanding may be had from the following description, given by way of example in conjunction with the accompanying drawings, wherein.

DETAILED DESCRIPTION

A method, a device, and a non-transitory computer readable medium for performing dithering on an L bit long input data are presented. An M bit long random data is generated, wherein M is a number of least significant bits of the input data. An M bit long frame counter value is added to the random data. The input data is rounded up to L-M most significant bits when the M least significant bits of the input data is greater than the sum of the frame counter value and the random data. The input data is truncated to the L-M most significant bits when the M least significant bits of the input data is less than or equal to the sum of the frame counter value and the random data.

Figure 1:
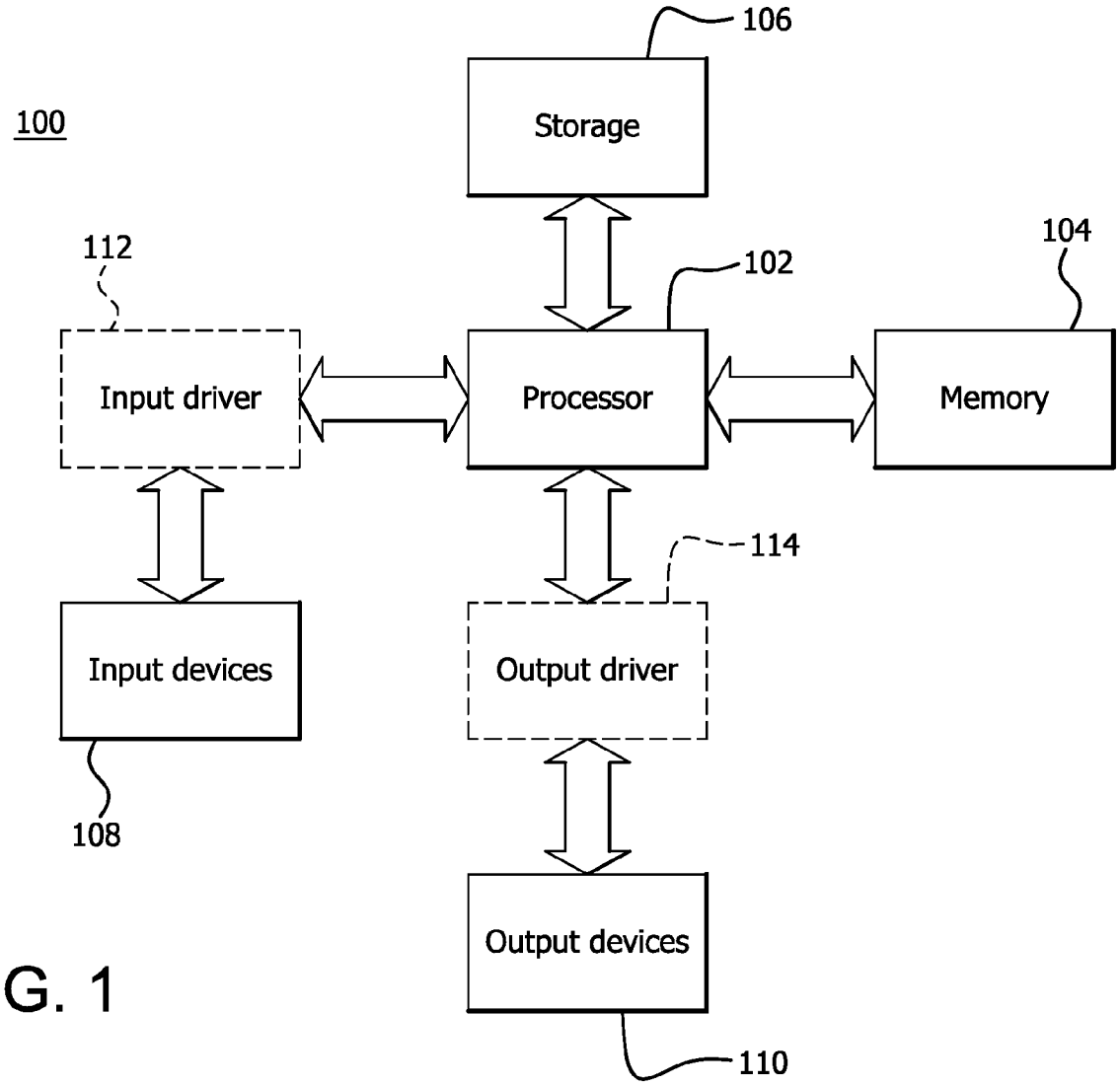
FIG. 1 is a block diagram of an example device in which one or more disclosed embodiments may be implemented.

FIG. 1 is a block diagram of an example device 100 in which one or more disclosed embodiments may be implemented. The device 100 may include, for example, a computer, a gaming device, a handheld device, a set-top box, a television, a mobile phone, or a tablet computer. The device 100 includes a processor 102, a memory 104, a storage 106, one or more input devices 108, and one or more output devices 110. The device 100 may also optionally include an input driver 112 and an output driver 114. It is understood that the device 100 may include additional components not shown in FIG. 1.

The processor 102 may include a central processing unit (CPU), a graphics processing unit (GPU), a CPU and GPU located on the same die, or one or more processor cores, wherein each processor core may be a CPU or a GPU. The memory 104 may be located on the same die as the processor 102, or may be located separately from the processor 102. The memory 104 may include a volatile or non-volatile memory, for example, random access memory (RAM), dynamic RAM, or a cache.

The storage 106 may include a fixed or removable storage, for example, a hard disk drive, a solid state drive, an optical disk, or a flash drive. The input devices 108 may include a keyboard, a keypad, a touch screen, a touch pad, a detector, a microphone, an accelerometer, a gyroscope, a biometric scanner, or a network connection (e.g., a wireless local area network card for transmission and/or reception of wireless IEEE 802 signals). The output devices 110 may include a display, a speaker, a printer, a haptic feedback device, one or more lights, an antenna, or a network connection (e.g., a wireless local area network card for transmission and/or reception of wireless IEEE 802 signals).

The input driver 112 communicates with the processor 102 and the input devices 108, and permits the processor 102 to receive input from the input devices 108. The output driver 114 communicates with the processor 102 and the output devices 110, and permits the processor 102 to send output to the output devices 110. It is noted that the input driver 112 and the output driver 114 are optional components, and that the device 100 will operate in the same manner if the input driver 112 and the output driver 114 are not present.

One goal in designing a new spatial dithering method is to use as small an amount of pixels as possible to achieve an intermediate color level. The spatial dithering method described herein is designed to reduce the flickering associated with random spatial dithering while providing an accurate average color value.

The dithering method described herein takes advantage of both temporal dithering and random spatial dithering. A frame counter is incremented by one for each frame starting from 0 to N−1 in every group of N frames. All frames in one frame group have the same random data sequence. This is done by loading the same random seed for a random number generator at the beginning of each frame. The random noise data is a combination of the random data and the frame counter. Within each group of N frames, the random noise data covers all values between 0 and N−1 at every pixel location. This makes the average color value the same over N frames for all pixels with the same input data value.

The data frames are divided into groups and each frame group contains N=2M frames, where M is the number of dropped bits. Dividing the frames into groups may be done by counting the frames from 0 to N−1 in each frame group. The same pseudo-random seed is loaded at the beginning of each frame in a frame group and the same random data sequence is generated from that seed in every frame. This will generate the same random data sequence for all frames in any frame group. A random pattern is generated for each pixel and is added to that pixel. Because the pattern is random for each pixel, there are no visible artifacts. The frame counter value is added to the random data and only the least significant M bits of the sum are retained. The sum will be different from frame to frame in each frame group. In each group of N frames, the random data at any pixel location covers all values from 0 to (N−1).

Because a truly random pattern is not controllable, using a truly random pattern may produce some visible artifacts. For example, it is possible to generate a random pattern of: 2-2-2-2-2-1-1-1-1-1, in which some pixels may be bright or dim for a short period of time, resulting in visible artifacts. It is desirable to control the average brightness of each pixel, but still retain the randomness properties. For example, the two least significant bits may be dropped, and random data is generated for the same pixel in each frame in a group of four frames.

Similar to random spatial dithering, the dithering method compares the M dropped bits value with M bits of random data. If the dropped M bit value is larger than the random data, then the L bit input data is rounded up to the most significant (L-M) bits. Otherwise, the input data is truncated to the most significant (L-M) bits. It is preferable to minimize the number of dropped bits, to be able to use as small a group of frames as possible, which shortens the processing time needed to determine the average color value.

In a group of frames, the same x, y pixel location will have the same random value, but each different x, y pixel location will have a different random value. For example, an add-in pattern with two bit values may be as shown in Table 3.

TABLE 3

| Frame number | Value added |
|---|---|
| 1 | 0 |
| 2 | 1 |
| 3 | 2 |
| 4 | 3 |

These four values (0, 1, 2, 3) will always be used in a group of four frames, regardless of the order in which the values are applied. Because this change is made across a group of four frames (a relatively short amount of time), the changes between the most significant L-M bits or the incremented most significant L-M bits on the dithering output will not be visually perceptible to the viewer. So for every group of four frames, each pixel (based on its x, y location) will reach the target average color value.

In the following, $P_{LSB}$ is the value of the M least significant bits of input pixel data and $P_{MSB}$ is the value of the (L-M) most significant bits of input pixel data. The dithering result for that pixel in a group of N consecutive frames is $(P_{MSB}+1)$ in $P_{LSB}$ frames and $P_{MSB}$ in $(N-P_{LSB})$ frames. The average dithering output value for that pixel is $((P_{MSB}+1)\times P_{LSB}+P_{MSB}\times(N-P_{LSB}))/N=P_{MSB}+P_{LSB}/N$. The average dithering output data value in N consecutive frames is the same as the target average value. This reduces the flickering with the determined average value for each pixel over N consecutive frames. The color accuracy is also improved.

Figure 2:
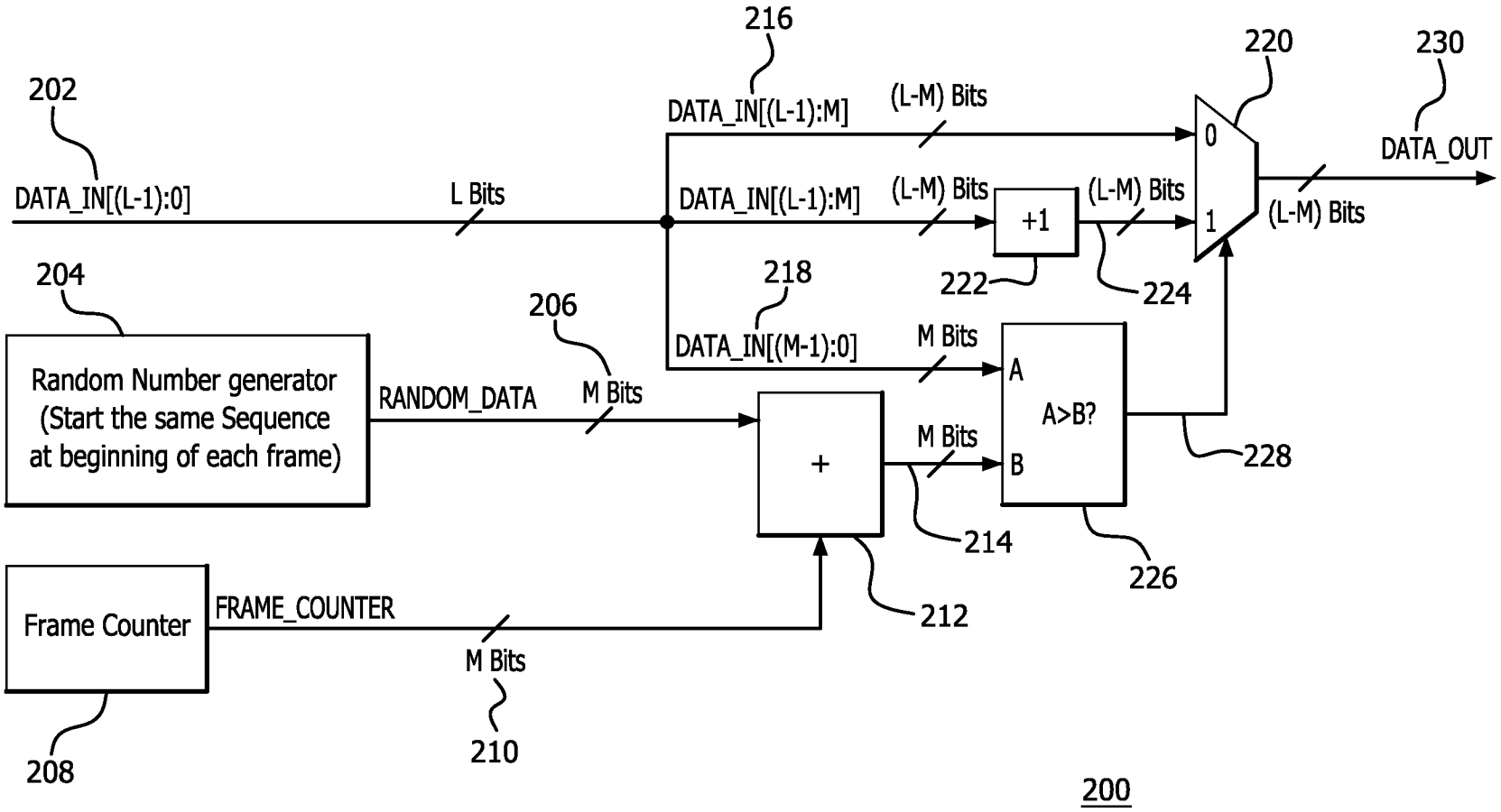
FIG. 2 is a diagram of an example dithering device.

FIG. 2 is a diagram of an example dithering device 200. An input data 202 is L bits in length. A random number generator 204 produces random data 206 that is M bits in length. As described herein the M bits are the least significant bits of the input data 202 that may be dropped. A frame counter 208 produces an M bit frame counter value 210. The random data 206 and the frame counter value 210 are inputs to an adder 212, which produces an M bit long combined value 214.

The input data 202 is separated into a most significant portion 216 (which is L-M bits long) and a least significant portion 218 (which is M bits long). One instance of the most significant portion 216 is passed to a multiplexer 220. A second instance of the most significant portion 216 is passed to an adder 222, which increments the most significant portion 216 to produce an increased value 224, which is also passed to the multiplexer 220. The least significant portion 218 is passed to a comparator 226, which also receives the combined value 214 from the adder 212.

The comparator 226 outputs a comparison result signal 228, which is used to select one of the inputs to the multiplexer 220, to produce the output data value 230. If the least significant portion 218 is greater than the combined value 214, then the output data value 230 of the multiplexer 220 is the increased value 224. If the least significant portion 218 is less than or equal to the combined value 214, then the output data value 230 of the multiplexer 220 is the most significant portion 216.

Figure 3:
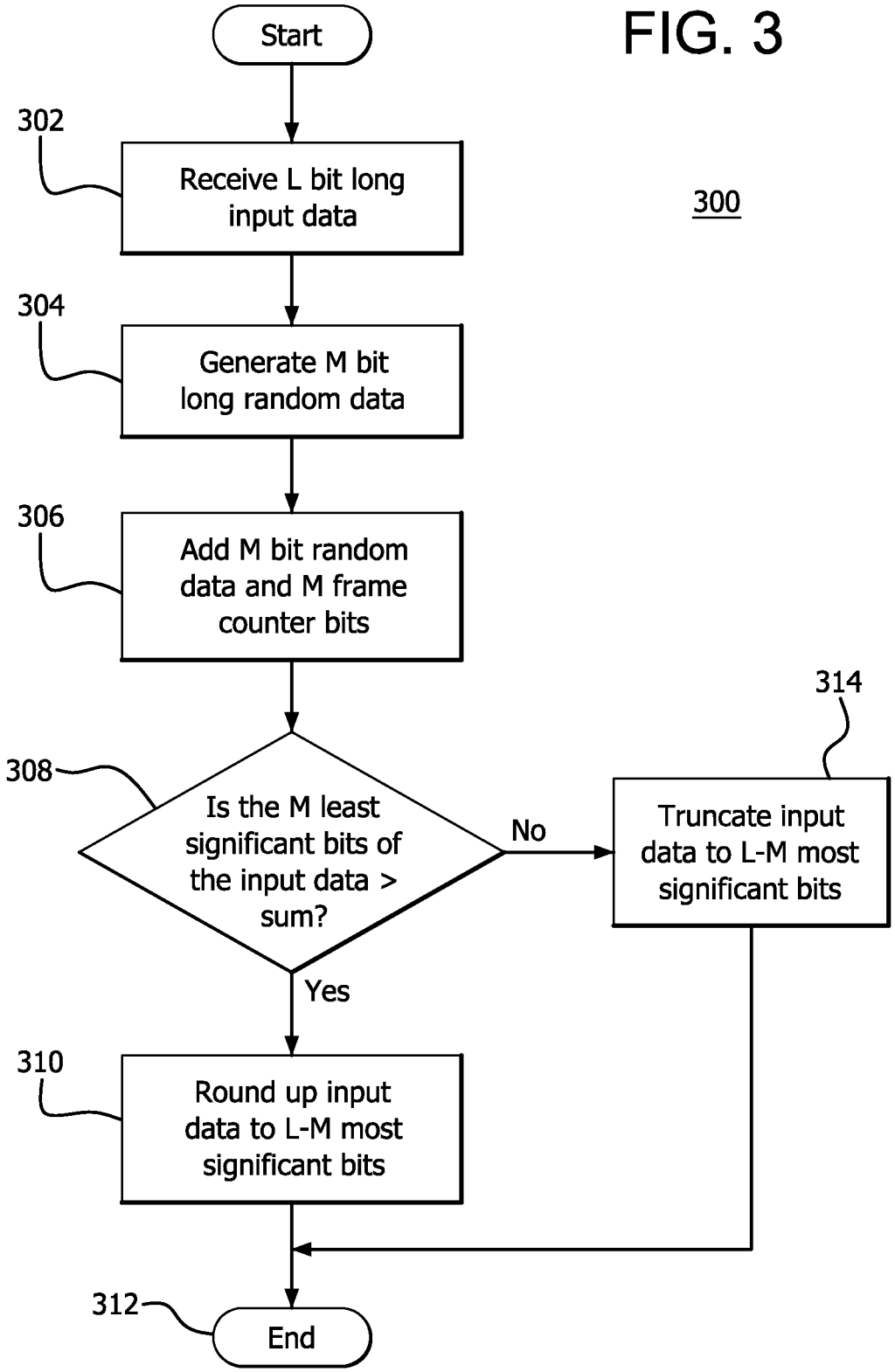
FIG. 3 is a flowchart of a method for spatial dithering.

FIG. 3 is a flowchart of a method 300 for spatial dithering. An L bit long input data is received (step 302). An M bit long random data is generated, where M is the number of bits to be dropped from the input data (step 304). The generated random data is added to an M bit frame counter value (step 306). A determination is made whether the M least significant bits of the input data is greater than the sum of the random data and the frame counter bits (step 308). If the M least significant bits of the input data is greater than the sum, then the input data is rounded up to the L-M most significant bits (step 310) and the method terminates (step 312). If the M least significant bits of the input data is less than or equal to the sum (step 308), then the input data is truncated to the L-M most significant bits (step 314) and the method terminates (step 312).

To obtain a further improvement, the frame counter data bits may be re-ordered via bit swap logic before being added to the random data. One benefit to swapping the frame counter bits is to increase high frequency on the output. This becomes more important when a large number of bits are dropped. For example, a 12 bit input data with a value of 32 is across a group of 64 frames and the input data is converted to six bits. Without the frame counter bit swapper, the output could change between 0 and 1 after every 32 frames. With a 60 Hz display, the pixel data toggles between 0 and 1 around every 0.5 seconds, which causes visible flicking. If the frame counter bit swap is enabled, the pixel data will toggle between 0 and 1 every 1/60 second. The average pixel data value is the same, but there is less visible flickering.

Assume that the frame counter is {Bit[M−1], Bit[M−2], . . . Bit[1], Bit[0]}. On each frame, the counter value changes by one. By re-ordering the frame data bits, the value {Bit[0], Bit[1], . . . Bit[M−2], Bit[M−1]} will have most significant bit toggles every frame, so there are fewer visible artifacts. By adding this value to the random data, it will increase high frequency on the dithering data output and reduce flickering with a large N (number of frames) value. For example, the high bit and the low bit may be swapped. Without frame counter bit swapping, the pattern is: 0-1-2-3, and with frame counter bit swapping, the pattern is: 0-2-1-3.

In Example 1, eight bit data is converted to six bit data.

```
If (beginning of the frame)
    frame_counter[1:0] = frame_counter[1:0] + 1.
If (beginning of the frame)
    If (frame_counter == 0) //first frame of a frame group
        group_random_seed = new_group_random_seed; //load
a new seed into group_random_seed
        random_seed = group_random_seed; //load
group_random_seed into random_seed for the first frame in a frame
group
    Else
        random_seed = group_random_seed; //load
group_random_seed into random_seed for the other frames in the frame
group
random_noise_data[1:0] = random_data[1:0] +
frame_counter[1:0];
```

The new_group_random_seed may optionally be loaded at beginning of the first frame in a frame group. Then group_random_seed is used for all frames by loading random_seed at beginning of each frame with the same seed (group_random_seed) in that frame group. The same random seed may be used for all frame groups if new_group_random_seed is set to the same value for every frame group.

In Example 2, ten bit data is converted to six bit data. One option is to have 16 frames in each frame group and frame counter[3:0] incrementing from 0-15, similar to Example 1. Another option is to swap the frame counter bits before adding the frame counter to the random data, to increase high frequency on the dithering data output and to reduce flickering.

```
If (beginning of the frame)
    frame_counter[3:0] = frame_counter[3:0] + 1.
If (beginning of the frame)
    If (frame_counter == 0)
        group_random_seed = new_group_random_seed;
        random_seed = group_random_seed;
    Else
        random_seed = group_random_seed;
random_noise_data[3:0] = random_data[3:0] + {frame_counter[0],
frame_counter[1], frame_counter[2], frame_counter[3]};
```

This method achieves the average color level and reduces flickering, which is mostly caused by random numbers generated and added to an x-y pixel location.

Figure 4:
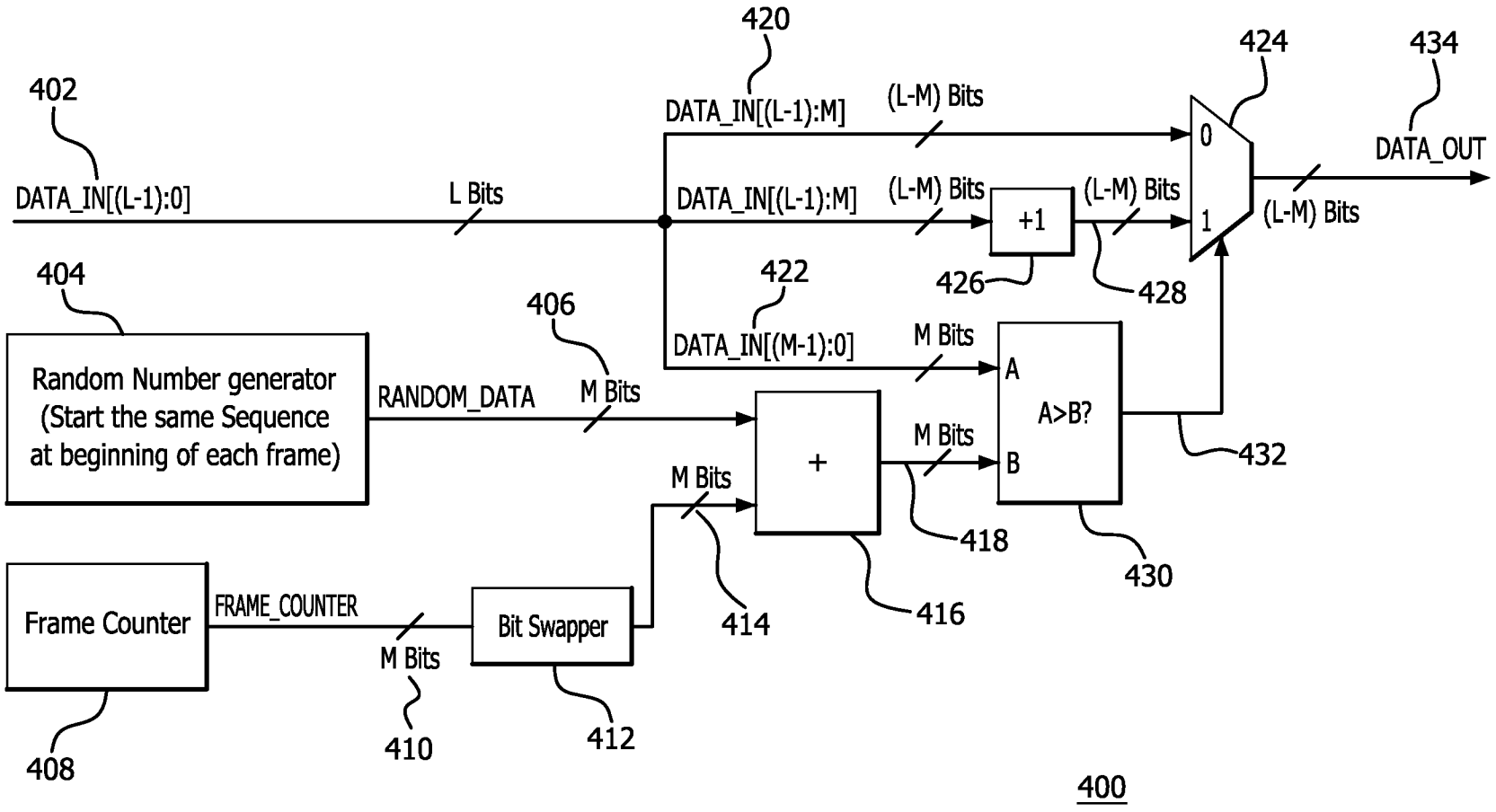
FIG. 4 is a diagram of another example dithering device.

FIG. 4 is a diagram of another example dithering device 400, including the frame counter bit swapping. An input data 402 is L bits in length. A random number generator 404 produces random data 406 that is M bits in length. As described herein the M bits are the least significant bits of the input data 402 that may be dropped. A frame counter 408 produces an M bit frame counter value 410.

A bit swapper 412 is configured to swap the M bits in the frame counter value 410 to produce a swapped value 414. The random data 406 and the swapped value 414 are inputs to an adder 416, which produces an M bit long combined value 418.

The input data 402 is separated into a most significant portion 420 (which is L-M bits long) and a least significant portion 422 (which is M bits long). One instance of the most significant portion 420 is passed to a multiplexer 424. A second instance of the most significant portion 420 is passed to an adder 426, which increments the most significant portion 420 to produce an increased value 428, which is also passed to the multiplexer 424. The least significant portion 422 is passed to a comparator 430, which also receives the combined value 418 from the adder 416.

The comparator 430 outputs a comparison result signal 432, which is used to select one of the inputs to the multiplexer 424, to produce the output data value 434. If the least significant portion 422 is greater than the combined value 418, then the output data value 434 of the multiplexer 424 is the increased value 428. If the least significant portion 422 is less than or equal to the combined value 418, then the output data value 434 of the multiplexer 424 is the most significant portion 420.

Figure 5:
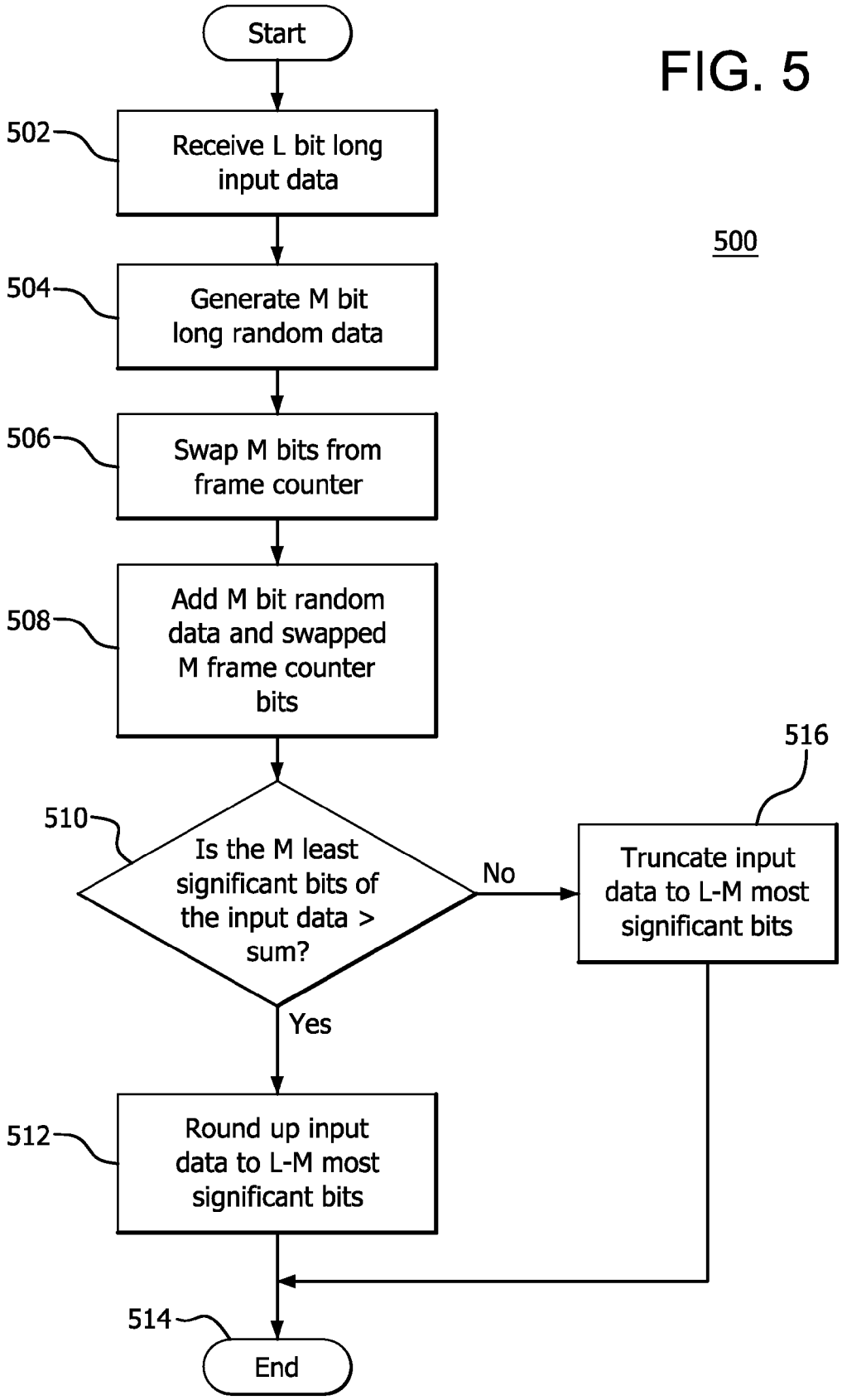
FIG. 5 is a flowchart of another method for spatial dithering.

FIG. 5 is a flowchart of another method 500 for spatial dithering, including the frame counter bit swapping. An L bit long input data is received (step 502). An M bit long random data is generated, where M is the number of bits to be dropped from the input data (step 504). Based on a current frame counter value, M bits of the frame counter are swapped (step 506). The generated random data is added to the swapped frame counter bits (step 508). A determination is made whether the M least significant bits of the input data is greater than the sum of the random data and the swapped frame counter bits (step 510). If the M least significant bits of the input data is greater than the sum, then the input data is rounded up to the L-M most significant bits (step 512) and the method terminates (step 514). If the M least significant bits of the input data is less than or equal to the sum (step 510), then the input data is truncated to the L-M most significant bits (step 516) and the method terminates (step 514).

It should be understood that many variations are possible based on the disclosure herein. Although features and elements are described above in particular combinations, each feature or element may be used alone without the other features and elements or in various combinations with or without other features and elements.

The methods provided may be implemented in a general purpose computer, a processor, or a processor core. Suitable processors include, by way of example, a general purpose processor, a special purpose processor, a conventional processor, a digital signal processor (DSP), a plurality of microprocessors, one or more microprocessors in association with a DSP core, a controller, a microcontroller, Application Specific Integrated Circuits (ASICs), Field Programmable Gate Arrays (FPGAs) circuits, any other type of integrated circuit (IC), and/or a state machine. Such processors may be manufactured by configuring a manufacturing process using the results of processed hardware description language (HDL) instructions and other intermediary data including netlists (such instructions capable of being stored on a computer readable media). The results of such processing may be maskworks that are then used in a semiconductor manufacturing process to manufacture a processor which implements aspects of the embodiments.

The methods or flow charts provided herein may be implemented in a computer program, software, or firmware incorporated in a non-transitory computer-readable storage medium for execution by a general purpose computer or a processor. Examples of non-transitory computer-readable storage mediums include a read only memory (ROM), a random access memory (RAM), a register, cache memory, semiconductor memory devices, magnetic media such as internal hard disks and removable disks, magneto-optical media, and optical media such as CD-ROM disks, and digital versatile disks (DVDs).

What is claimed is:

1. A method, comprising:

receiving an image with an L bit long pixel input data;

generating an M bit long random data, wherein M is a number of least significant bits of the input data;

adding an M bit long frame counter value to the random data;

rounding up the pixel input data to L-M most significant bits when the M least significant bits of the pixel input data is greater than the sum of the frame counter value and the random data;

truncating the pixel input data to the L-M most significant bits when the M least significant bits of the pixel input data is less than or equal to the sum of the frame counter value and the random data and dithering the image by replacing the L bit long pixel input data with the L-M bit long most significant bits of the rounded UP pixel input data and the L-M bit long most significant bits of the truncated pixel input data.

2. The method according to claim 1, wherein the method is performed on a group of N frames, wherein $N=2^M$.

3. The method according to claim 2, wherein the generating includes loading a pseudo-random seed for a first frame in a frame group.

4. The method according to claim 1, further comprising:

swapping the bits in the frame counter value prior to adding the frame counter value to the random data.

5. The method of claim 1, further comprising:

outputting the rounded pixel input data or the truncated pixel input data for display.

6. The method of claim 5, wherein:

the M bit long frame counter value comprises an M bit long display frame counter value that uniquely identifies a particular display frame.

7. A non-transitory computer-readable storage medium storing a set of instructions for execution by a general purpose computer to perform dithering on an L bit long input data, the set of instructions comprising:

an image receiving code segment for receiving an image with an L bit long pixel input data;

a generating code segment for generating an M bit long random data, wherein M is a number of least significant bits of the pixel input data;

an adding code segment for adding an M bit long frame counter value to the random data;

a rounding code segment for rounding up the input data to L-M most significant bits when the M least significant bits of the pixel input data is greater than the sum of the frame counter value and the random data;

a truncating code segment for truncating the pixel input data to the L-M most significant bits when the M least significant bits of the pixel input data is less than or equal to the sum of the frame counter value and the random data; and an image dithering code segment for dithering the image by replacing the L bit long pixel input data with the L-M bit long most significant bits of the rounded UP pixel input data and the L-M bit long most significant bits of the truncated pixel input data.

8. The non-transitory computer-readable storage medium according to claim 7, further comprising:

a swapping segment configured to swap the bits in the frame counter value prior to adding the frame counter value to the random data.

9. The non-transitory computer-readable storage medium according to claim 7, wherein the instructions are hardware description language (HDL) instructions used for the manufacture of a device.

10. The non-transitory computer-readable storage medium of claim 7, the set of instructions further comprising:

a selecting code segment for selecting either of the rounded up input pixel data or the truncated input pixel data for display.

11. The non-transitory computer-readable storage medium of claim 10, wherein:

the M bit long frame counter value comprises an M bit long display frame counter value that uniquely identifies a particular display frame.

12. A device configured to perform dithering on an image with an L bit long pixel input data, comprising:

a random number generator, configured to generate an M bit long random data, wherein M is a number of least significant bits of the pixel input data;

a frame counter, configured to generate an M bit long frame counter value;

a first adder, configured to add the random data and the frame counter value to produce a sum;

a comparator, configured to compare M least significant bits of the pixel input data and the sum to produce a comparison signal;

a second adder, configured to increment L-M most significant bits of the pixel input data by one; and a hardware multiplexer, configured to:

receive the L-M most significant bits of the pixel input data, the incremented L-M most significant bits of the pixel input data, and the comparison signal; and produce an output based on the comparison signal, wherein the output is:

the incremented L-M most significant bits of the pixel input data when the M least significant bits of the pixel input data is greater than the sum of the frame counter value and the random data; and the L-M most significant bits of the pixel input data when the M least significant bits of the pixel input data is less than or equal to the sum of the frame counter value and the random data; and dither the image by replacing the L bit long pixel input data with the output data.

13. The device according to claim 12, wherein the device is configured to operate on a group of N frames, wherein $N=2^M$.

14. The device according to claim 13, wherein the random number generator is further configured to load a pseudo-random seed for a first frame in a frame group.

15. The device according to claim 12, further comprising a bit swapper, configured to receive the frame counter value and to swap the bits of the frame counter value, to produce a swapped frame counter value; and wherein the first adder is further configured to add the random data and the swapped frame counter value to produce the sum.

16. The device of claim 12, wherein:

the multiplexor is further configured to output the rounded pixel input data or the truncated pixel input data for display.

17. The device of claim 16, wherein:

the M bit long frame counter value comprises an M bit long display frame counter value that uniquely identifies a particular display frame.

* * * * *